US008956427B2

(12) United States Patent
Young et al.

(10) Patent No.: US 8,956,427 B2
(45) Date of Patent: Feb. 17, 2015

(54) GASIFICATION CHAMBER WITH MASS FLOW WEDGE MEMBERS

(75) Inventors: Matthew Young, Acton, MA (US); Joseph Abner, Middleboro, MA (US); Harris Gold, Lexington, MA (US)

(73) Assignee: MSW Power Corporation, Acton, MA (US)

( * ) Notice: Subject to any disclaimer, the term of this patent is extended or adjusted under 35 U.S.C. 154(b) by 1064 days.

(21) Appl. No.: 12/928,892

(22) Filed: Dec. 21, 2010

(65) Prior Publication Data

US 2012/0151839 A1 Jun. 21, 2012

(51) Int. Cl.

| | |
|---|---|
| ***B01J 7/00*** | (2006.01) |
| ***C10J 3/26*** | (2006.01) |
| ***C10J 3/20*** | (2006.01) |

(52) U.S. Cl.

CPC ..... *C10J 3/26* (2013.01); *C10J 2300/0956* (2013.01); *C10J 2200/152* (2013.01); *C10J 3/20* (2013.01)

USPC ..... 48/61

(58) Field of Classification Search

CPC ..... C10J 3/26; C10J 3/34; C10J 2200/152; C10J 3/20; C10J 2200/09; C10J 2200/15; F23G 2900/50002; F23G 5/24; B01J 2208/00752; B01J 2219/187; B65G 53/40

See application file for complete search history.

(56) References Cited

U.S. PATENT DOCUMENTS

| | | | | |
|---|---|---|---|---|
| 3,968,626 | A | 7/1976 | Hobbs | |
| 5,226,927 | A | 7/1993 | Rundstrom | |
| 5,787,822 | A | 8/1998 | Hilliard | |
| 6,199,405 | B1 | 3/2001 | Buettiker | |
| 6,647,903 | B2 | 11/2003 | Ellis | |
| 7,736,402 | B2 | 6/2010 | Crorey, Jr. | |
| 2005/0109603 | A1 | 5/2005 | Graham | |
| 2006/0107595 | A1 * | 5/2006 | Davison et al. | 48/127.5 |
| 2006/0196810 | A1 * | 9/2006 | Calderon et al. | 208/108 |
| 2006/0243583 | A1 * | 11/2006 | Sprouse et al. | 202/262 |
| 2007/0006528 | A1 | 1/2007 | Diebold et al. | |
| 2007/0289216 | A1 | 12/2007 | Tsangaris et al. | |
| 2009/0090282 | A1 | 4/2009 | Gold et al. | |
| 2010/0313796 | A1 * | 12/2010 | Graham et al. | 110/229 |
| 2011/0030590 | A1 * | 2/2011 | Davison et al. | 110/229 |
| 2011/0072722 | A1 | 3/2011 | Young et al. | |
| 2011/0139257 | A1 * | 6/2011 | Bielenberg et al. | 137/1 |
| 2011/0139583 | A1 * | 6/2011 | Bielenberg et al. | 198/604 |

OTHER PUBLICATIONS

Written Opinion of the International Searching Authority for International Application No. PCT/US2011/001972, five (5) pages, unnumbered.

J. Marinelli and Dr. John W. Carson, "Solve Solids Flow Problems in Bins, Hoppers, and Feeders", Chemical Engineering Progress, Jun. 2001. (ten (10) pages).

Thomas B. Reed and Agua Das, "Handbook of Biomass Downdraft Gasifier Engine Systems", Biomass Energy Foundation Press. (four (4) pages).

Jenike & Johanson, "Bulk Solids: Science/ Engineering/ Design", http://www.jenike.com/projects/cement_titan.html printed Aug. 10, 2010 (three (3) pages).

* cited by examiner

*Primary Examiner* — Imran Akram

(74) *Attorney, Agent, or Firm* — Iandiorio Teska & Coleman, LLP

(57) ABSTRACT

A gasifier includes a gasification chamber including an annular chamber wall with a top opening for introducing fuel into the gasification chamber. A restricted bottom outlet section of the gasification chamber has inwardly angled wedge walls encouraging a mass flow rather than a funnel-flow of fuel through the gasifier.

16 Claims, 4 Drawing Sheets

GASIFICATION CHAMBER WITH MASS FLOW WEDGE MEMBERS

FIELD OF THE INVENTION

The subject invention relates to a down draft gasifier.

BACKGROUND OF THE INVENTION

In a typical downdraft gasifier, a vertically oriented gasification chamber receives feed stock (a fuel) which is combusted by pyrolysis in the gasification chamber. U.S. Pat. No. 6,647,903, incorporated herein by this reference, discloses a hollow cylinder with a lower cone-shaped section terminating in a restricted opening in order to retain the fuel in the gasifier and yet also allow spent fuel (char and ash) to exit the gasifier. In this way, fuel continually enters the gasifier and spent fuel continually exits the gasifier.

Steady fuel flow through a gasifier results in improved gasification, better gas quality, lower tar content, and higher yield. If the fuel flows too quickly through the gasifier, pyrolysis of the fuel is diminished and/or tar production increases. If the fuel flows too slowly through the gasifier, the fuel and/or char can build up in the gasifier and on the walls of the gasifier reducing gas quality. Gasifiers frequently suffer from bridging or channeling of the fuel. See *Handbook of Biomass Downdraft Gasifier Engine Systems*, Reed and Das, 1998 (Biomass Energy Foundation Press).

A gasifier with fairly steep long sloping walls defines a mass flow of fuel through the gasifier which provides an adequate flow of fuel through the gasifier but results in a gasifier with a restricted volume. The conical shaped gasifier thus must be rather tall and is not well adapted for use in portable, transportable, or on-site applications such as disclosed in co-pending U.S. patent application Ser. No. 12/070,032 incorporated herein by this reference.

A gasifier with short, less steep sloping walls at the outlet of the gasifier results in a funnel flow of the fuel. Fuel proximate the walls of the gasifier moves downward too slowly and interior fuel moves downward too quickly. Gasifier designs exhibiting a funnel-flow pattern results in material flowing preferentially through a funnel-shape channel located directly above the gasifier outlet while material outside this flow channel is stagnant. In some prior art designs, vibrators are provided for agitating the contents of the gasification chamber. See U.S. Pat. No. 7,736,402 incorporated herein by this reference.

There is a trade off, then, between the size of the gasifier and gasification parameters such as gas quality. For hoppers, mass flow and funnel flow are discussed in the paper *"Solve Solids Flow Problems in Bins, Hoppers, and Feeders"* by J. Marinelli and Dr. John W. Carson (June 2001), incorporated herein by this reference.

BRIEF SUMMARY OF THE INVENTION

In one aspect, a new gasifier is provided which is configured to encourage a mass flow of fuel through the gasifier and yet, at the same time, results in less of a volume reduction than a gasifier configured with a curved chamber wall which slops inwardly.

The invention features a gasifier comprising a gasification chamber including an annular chamber wall with a top opening for introducing fuel into the gasification chamber, a plurality of air inlets opening into the gasification chamber, and a restricted bottom outlet section of the gasification chamber.

Inwardly angled wedge walls encouraging a mass flow rather than a funnel-flow of fuel through the gasifier. Portions of the annular chamber wall between the inwardly angled wedge walls are not angled inwardly to increase the volume of the gasification chamber. In another aspect, a restricted bottom outlet section of the gasification chamber includes inwardly angled wedge walls with flat faces defining a discharge outlet having straight opposing edges co-joining curved sections of the annular chamber wall.

The air inlets may be flush with the annular chamber wall and typically there are air inlets through the inwardly angled wedge walls.

The inwardly angled wedge walls preferably slope inwardly at an angle of between 6° and 18° (e.g., 12°), the width of the wedge walls is between 90 and 95% of the diameter of the chamber wall, and the height of the wedge walls is between 50 and 60% of the height of the chamber. Typically, the top of each wedge wall is curved and smoothly co-joins the chamber wall. In one design, the wedge walls oppose each other in the chamber.

The subject invention, however, in other embodiments, need not achieve all these objectives and the claims hereof should not be limited to structures or methods capable of achieving these objectives.

BRIEF DESCRIPTION OF THE SEVERAL VIEWS OF THE DRAWINGS

Other objects, features and advantages will occur to those skilled in the art from the following description of a preferred embodiment and the accompanying drawings, in which.

DETAILED DESCRIPTION OF THE INVENTION

Figure 1:
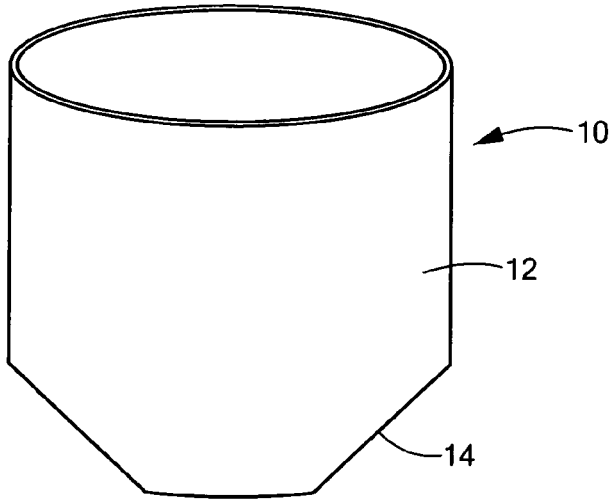
FIG. 1 Prior Art
FIG. 1 is a highly schematic front view of a prior art gasifier configured to result in a funnel flow of fuel through the gasifier.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 schematically depicts gasifier 10 with a hollow cylinder portion 12 and restricted bottom outlet 14. See U.S. Pat. No. 7,736,402 incorporated herein by this reference. In such a funnel-flow design, as noted in the Background section above, fuel flows preferentially through a funnel-shaped channel located directly above outlet 14 while material outside this flow channel is stagnant. The result can be fuel proximate the walls of the gasification chamber moving downward too slowly through the gasifier and fuel interior to the walls of the gasification chamber moving downward too quickly.

Figure 2:
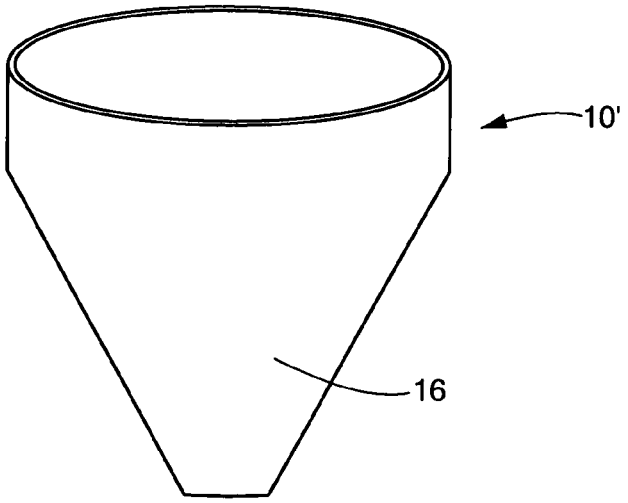
FIG. 2 Prior Art
FIG. 2 is a highly schematic front view showing an example of a prior art gasifier configured to result in a mass flow of fuel through the gasifier.

FIG. 2 schematically depicts gasifier 10' with fairly long and steep sloping curved wall 16 resulting in a mass flow of fuel through the gasifier which is preferred. But, now the volume of the gasifier is greatly reduced as noted in the Background section above. Thus, for gasifier 10', FIG. 2 to have the same capacity as gasifier 10, FIG. 1, gasifier 10', FIG. 2 must be significantly taller which is disadvantageous in some applications such as portable, transportable, and/or on-site waste to energy systems.

In embodiments of the subject invention, an engineering compromise is made between the gasifier designs of FIGS. 1 and 2. In one preferred embodiment, gasifier 30, FIG. 3-4 includes gasification chamber 32 with top opening 34 for introducing fuel such as dried waste in pellet form into gasification chamber 32. A plurality of air inlets 36 open through annular inner chamber wall 38 and supply air into the gasification chamber via piping 40.

Gasifier 30 includes restricted bottom outlet section 44 for maintaining fuel in the gasification chamber to maintain pyrolysis of the fuel. Restricted bottom outlet section 44 also allows spent fuel, char, and the like to exit the gasification chamber. A grate subsystem may be disposed below restricted outlet 44 as disclosed in co-pending U.S. patent application Ser. No. 12/586,830 incorporated herein by this reference.

Restricted bottom outlet section 44 is defined by inwardly angled wedge walls 48*a* and 48*b* designed to encourage a mass flow rather than a funnel-flow of fuel through gasification chamber 32. To avoid a sharp decrease in the volume of chamber 32, portions of the curve chamber wall 38 between inwardly angled wedge walls 48*a* and 48*b* are not angled inwardly as shown at 50 and instead continues straight down from the top of the gasifier to the bottom thereof.

Figure 4:
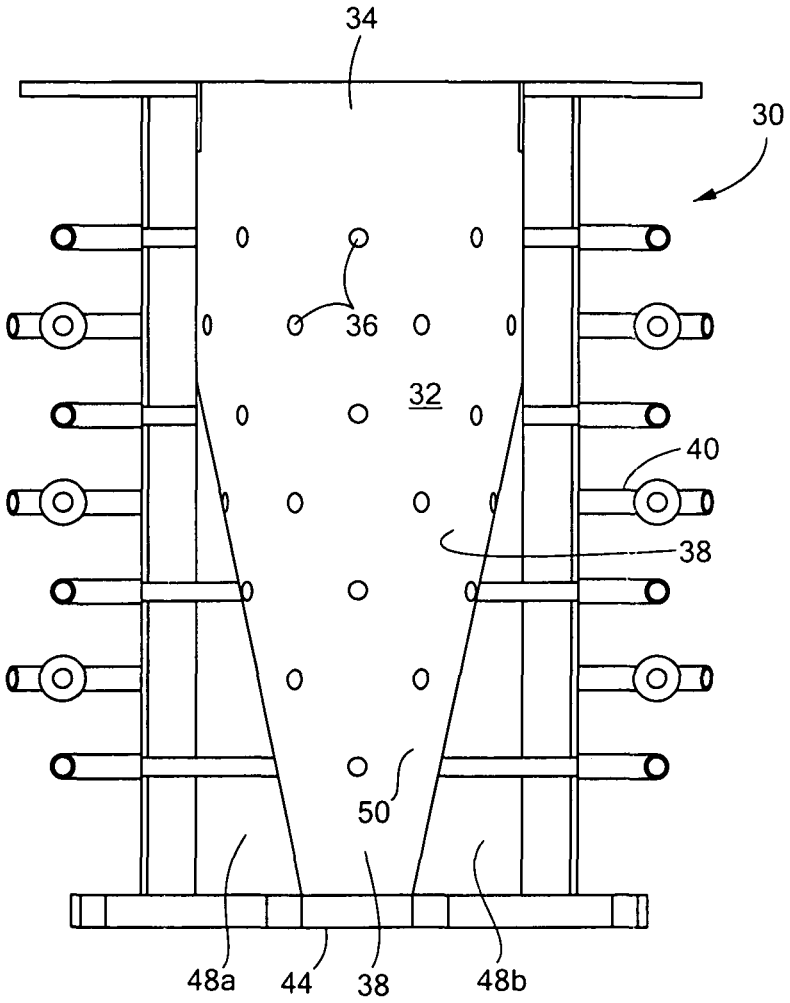
FIG. 4 is a cross-sectional front view of the gasifier shown in FIG. 3.
Figure 5:
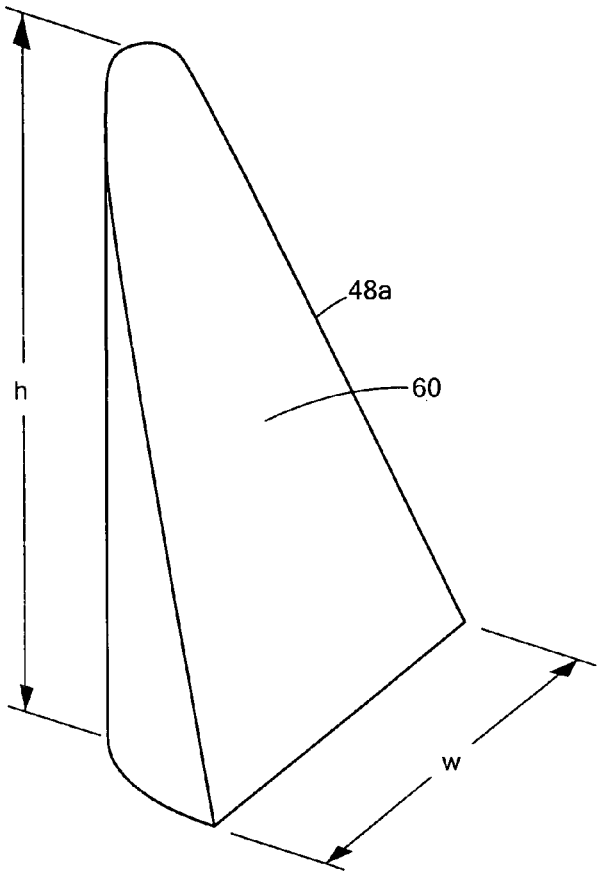
FIG. 5 is a highly schematic three-dimensional view showing an example of a gasifier chamber wedge wall within the gasifier shown in FIGS. 3-4.
Figure 6:
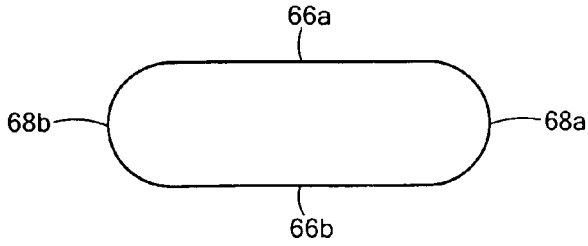
FIG. 6 is a schematic top view depicting the configuration of a preferred gasifier outlet for the gasifier shown in FIGS. 3-4 in accordance with the invention.

In this preferred design, opposing inwardly angled wedge walls 48*a* and 48*b* have flat faces as shown at 60 in FIG. 5 for wall 48*a*. This design defines a discharge outlet as depicted in FIG. 6 with straight opposing edges 66*a* and 66*b* adjoining curve sections 68*a* and 68*b* of annular chamber wall 38, FIGS. 3-4. This design approximates a transition hopper design used in material handling. In a traditional transition hopper design, however, all the walls at the discharge portion slope inwardly.

Air inlets 36 may be flush with chamber wall 38 or short nozzles may be used. Inwardly angled wedge walls 48*a* and 48*b* may also include air inlets as shown.

Figure 3:
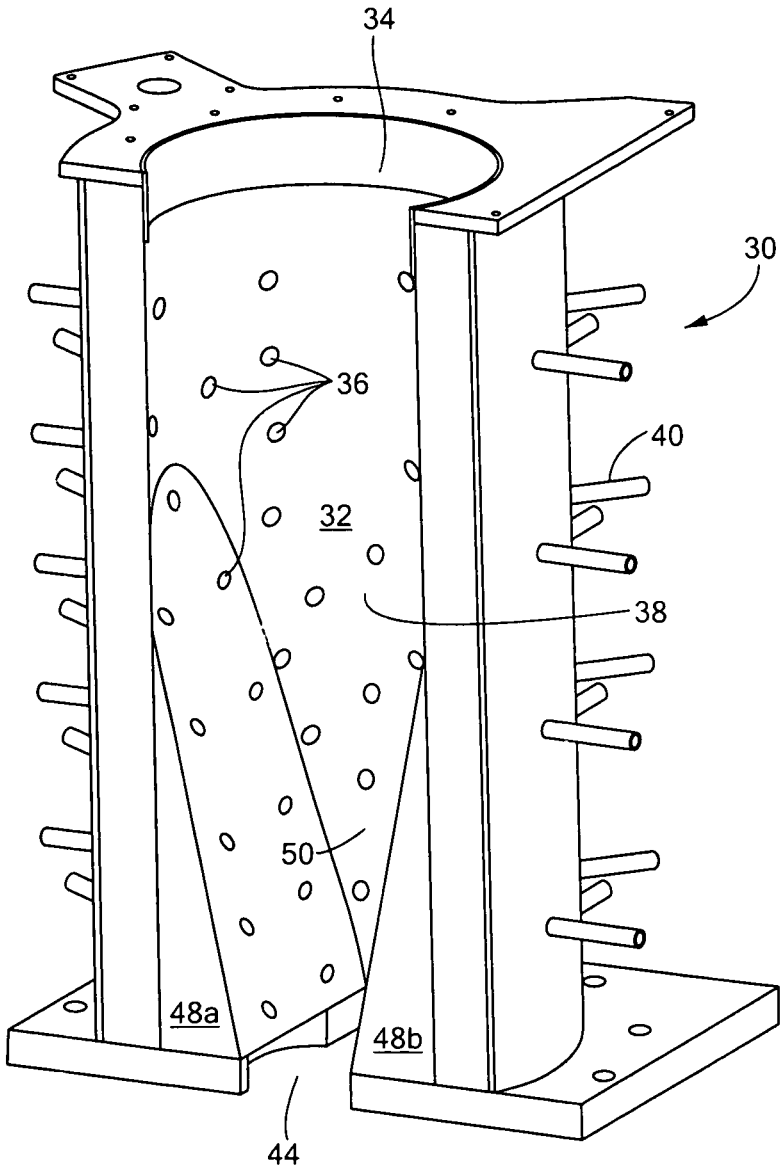
FIG. 3 is a schematic three-dimensional cutaway view showing an example of a gasifier in accordance with the invention.

Inwardly angled wedge walls 48*a* and 48*b* may slope inwardly at an angle of between 6° and 18°. In one prototype unit, angle θ, FIG. 5, was 12°. The width W, FIG. 5, of each wedge wall may be between 90 and 98% of the diameter of the gasification chamber inner wall. In the prototype unit, the gasification inner chamber wall was 19¼ inches in diameter and W was 18.12 inches. The length or height of each wedge wall may be between 50 and 60% of the length of the chamber. In the prototype unit, the chamber was 52 inches tall and h, FIG. 5, was approximately 30 inches. As shown in FIGS. 3-5, the top of each wedge wall may be curved at the top and smoothly co-joining with the chamber wall in a fashion such that there are no edges interfering with fuel flow through the chamber.

For the design shown in FIG. 2, with a gasifier 52 inches tall with a sloping wall, the volume of the gasifier would be 5.18 $ft^3$. In the design shown in FIG. 3, gasifier 30 had a volume of 7.46 $ft^3$. To achieve this same volume, the design shown in FIG. 2 would need to be 65.62 inches tall.

The gasifier of the invention can be machined or formed to include integral sloping wedge walls or a hollow straight cylinder can be fabricated separately from wedge walls 48*a* and 48*b* and the wedge walls inserted into the hollow straight cylindrically shaped chamber and secured to the non-inwardly sloping curved chamber wall.

In one preferred design, all the interior surfaces of gasification chamber 32 are lined with refractory material and polished. Stainless steel is the typical material used in the construction of the gasifier components.

The result is a gasifier with a steady flow of fuel therethrough providing better gasification, a higher gas quality, lower tar content and a higher yield. Gasifier 30, FIGS. 3-4 is configured to encourage a mass flow of fuel through gasification chamber 32 and yet at the same time there is less of a volume reduction when compared to the gasifier design shown in FIG. 2 where the curved chamber wall slopes inwardly at a fairly shallow angle resulting in long inwardly sloping curved gasification chamber walls.

Although specific features of the invention are shown in some drawings and not in others, however, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

Other embodiments will occur to those skilled in the art and are within the following claims.

What is claimed is:

1. A gasifier comprising:

a gasification chamber including an annular chamber wall with a top opening for introducing fuel into the gasification chamber;

a plurality of air inlets opening into the gasification chamber; and a restricted bottom outlet section of the gasification chamber comprising:

at least two spaced inwardly angled wedges encouraging a mass flow rather than a funnel-flow of fuel through the gasifier, portions of the annular chamber wall between the spaced inwardly angled wedges being not angled inwardly to increase the volume of the gasification chamber; and a central discharge outlet defined by said spaced inwardly angled wedge walls and annular chamber wall portions, said wedge walls not overhanging or covering the central discharge outlet.

2. The gasifier of claim 1 in which the spaced inwardly angled wedges have flat sloping faces defining a discharge outlet having straight opposing edges adjoining curved sections of the annular chamber wall.

3. The gasifier of claim 1 in which the air inlets are flush with the annular chamber wall.

4. The gasifier of claim 1 in which there are air inlets through the spaced inwardly angled wedges.

5. The gasifier of claim 1 in which the spaced inwardly angled wedges slope inwardly at an angle of between 6° and 18°.

6. The gasifier of claim 1 in which the width of the spaced wedges is between 90 and 95% of the diameter of the chamber wall.

7. The gasifier of claim 1 in which the height of the spaced wedges is between 50 and 60% of the height of the chamber.

8. The gasifier of claim 1 in which the top of each spaced wedges is curved and smoothly co-joins the chamber wall.

9. The gasifier of claim 1 in which the spaced wedges oppose each other in the chamber.

10. A gasifier comprising:

a gasification chamber including an annular chamber wall with a top opening for introducing fuel into the gasification chamber;

a plurality of air inlets opening into the gasification chamber; and a restricted bottom outlet section of the gasification chamber comprising:

spaced inwardly angled wedges encouraging a mass flow rather than a funnel-flow of fuel through the gasifier, portions of the annular chamber wall between the spaced inwardly angled wedges being not angled inwardly to increase the volume of the gasification chamber, and the spaced inwardly angled wedges having flat faces defining a central discharge outlet having straight opposing edges adjoining curved sections of the annular chamber wall, the wedges not overhanging or covering the central discharge outlets.

11. The gasifier of claim 10 in which there are air inlets through the spaced inwardly angled wedges.

12. The gasifier of claim 1 in which the spaced inwardly angled wedges slope inwardly at an angle of between 6° and 18°.

13. The gasifier of claim 10 in which the width of the spaced wedges is between 90 and 95% of the diameter of the chamber wall.

14. The gasifier of claim 10 in which the height of the spaced wedges is between 50 and 60% of the height of the chamber.

15. The gasifier of claim 10 in which the top of each spaced wedges is curved and smoothly co-joins the chamber wall.

16. The gasifier of claim 10 in which the spaced wedges oppose each other in the chamber.

* * * * *